US012618606B2

(12) United States Patent
Junge

(10) Patent No.: US 12,618,606 B2
(45) Date of Patent: May 5, 2026

(54) HEATED DOOR FOR A REFRIGERATOR APPLIANCE

(71) Applicant: Haier US Appliance Solutions, Inc., Wilmington, DE (US)

(72) Inventor: Brent Alden Junge, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 971 days.

(21) Appl. No.: 17/860,274

(22) Filed: Jul. 8, 2022

(65) Prior Publication Data

US 2024/0011698 A1 Jan. 11, 2024

(51) Int. Cl.
*F25D 21/04* (2006.01)

(52) U.S. Cl.
CPC ..... *F25D 21/04* (2013.01); *F25D 2400/02* (2013.01); *F25D 2400/06* (2013.01)

(58) Field of Classification Search
CPC .. F25D 21/04; F25D 2400/02; F25D 2400/06; F25D 2323/021
See application file for complete search history.

(56) References Cited

U.S. PATENT DOCUMENTS

2008/0209812 A1* 9/2008 Lancry ..... F25D 23/087 49/316
2019/0234668 A1* 8/2019 Yeom ..... F25C 5/08
2019/0338998 A1 11/2019 Ballester
2022/0090846 A1 3/2022 Smajser et al.

FOREIGN PATENT DOCUMENTS

JP 2021025664 A 2/2021
KR 101602270 B1 * 3/2016 ..... F25D 23/028

* cited by examiner

*Primary Examiner* — Tiffany T Tran
(74) *Attorney, Agent, or Firm* — Dority & Manning, P.A.

(57) ABSTRACT

A refrigerator appliance having an articulating mullion includes features for reducing localized condensation on the mullion of the refrigerator appliance. The door and the articulated mullion of the refrigerator appliance include features that can reduce the formation of condensation by providing heat to specific areas of the door or mullion.

8 Claims, 5 Drawing Sheets

HEATED DOOR FOR A REFRIGERATOR APPLIANCE

FIELD OF THE INVENTION

The present disclosure is related generally to refrigerator appliances and more particularly to a door having a heated portion for refrigerator appliances.

BACKGROUND OF THE INVENTION

Refrigerator appliances generally include one or more chilled compartments, e.g., a fresh food compartment, a freezer compartment, or the like, to maintain foods at low temperatures (i.e., lower than ambient). The chilled compartment(s) of a refrigerator are typically accessible through an opening, with access provided by one or more doors connected by hinges to the rest of the appliance.

Some refrigerator appliances include two rotatably mounted opposing doors for access to a single opening, e.g., the fresh food compartment. Such door configurations are generally referred to as "French doors." French doors are desirable because they reduce the weight load on the door hinge. French doors divide the opening in two, such that each door weighs less than a single door would weigh. The relatively reduced weight of each individual door in a French door configuration allows the size of the support structure of each door to be reduced. French doors also increase accessibility to the refrigerator cabinet and provide additional storage arrangements that are not possible with a single-door design.

However, French doors require additional sealing areas; in particular, the middle portion of the refrigerator opening where the two doors meet must maintain a seal when the doors are closed. Accordingly, some French door refrigerators include a stationary vertical mullion bar in the middle of the corresponding opening, and each of the two doors may sealingly engage the stationary mullion. A stationary mullion limits the size of items that can be put into the refrigerator. Some French door refrigerators include an articulating mullion rotatably attached via pivot points or hinges to one of the doors such that access to the compartment via the opening is not obstructed by the mullion when the door to which the articulating mullion is attached is opened. When closed, each of the doors sealingly engages the mullion with opposing edges of the doors spaced apart for clearance.

Conventional mullions for French door refrigerator appliances, and in particular articulated mullions, are generally formed, at least partially, of thermally conductive materials, such as e.g., metal. Thermally conductive materials are chosen because they typically have advantageous magnetic properties. The magnetic properties of the thermally conducting material allow such articulated mullions to seal against a magnetized sealing element or a magnetized portion of a cabinet or door of a refrigerator appliance when the door(s) of the refrigerator appliance are in a closed position.

During closed-door operation of such French door refrigerator appliances, relatively cool air within the refrigerator appliance contacts an interior or rear wall of the articulating mullion while relatively warm ambient air surrounding the refrigerator appliance contacts an exterior or front wall of the articulating mullion in the space between opposing door side surfaces, resulting in a temperature differential. When the warm ambient air contacts the cool front wall, the warm air is cooled on contact and may cause condensation or "sweat" on the front wall depending on the humidity of the ambient air. The condensation is unsightly and may collect in areas that can cause a safety concern (e.g., a risk or mold or mildew growth) or negatively affect the performance of the refrigerator appliance.

To prevent such condensation, conventional articulating mullions typically include an electrically powered heating device within the mullion to remedy this undesirable effect. The heating device may heat at least the exterior wall of the mullion to a temperature sufficient to minimize or prevent the moisture present in the ambient air from condensing on the articulating mullion.

To provide power to these heating devices, electrically conductive wires are typically routed from the door to which the articulating mullion is attached to the heating element within the mullion. However, routing conductors from the door to the heating element in the mullion may be problematic. For example, for safety and aesthetic reasons, exposed conductors between the door and the articulating mullion may be undesirable. Routing conductors through pivot points subjects the conductors to repeated bending and undesired stresses. The design of some pivot points linking a French door to an articulating mullion make the routing of wires impractical or impossible.

Accordingly, improved doors and articulating mullions for use in refrigerator appliances that address one or more of the above-described challenges would be beneficial.

BRIEF DESCRIPTION OF THE INVENTION

The present subject matter is directed to a refrigerator appliance having a door and an articulating mullion that includes features for improving the performance of the refrigerator appliance. In particular, the mullion and a door of the refrigerator appliance include features that may reduce the amount of condensation on the outside face of a mullion. Additional aspects and advantages of the invention will be set forth in part in the following description, or may be apparent from the description, or may be learned through practice of the invention.

In an exemplary aspect, a refrigerator appliance is provided. The refrigerator appliance defines a vertical direction, a lateral direction, and a transverse direction, the vertical, lateral, and transverse directions being mutually perpendicular. The refrigerator also includes a cabinet having laterally spaced walls defining a lateral dimension of a chamber and a top and a vertically spaced bottom defining a vertical dimension of the chamber. A door is provided, hinged at a first side to a wall for rotation between a closed position, enclosing a portion of the chamber, and an open position. The door includes an inner surface spaced from an outer surface, a first side and a second side connecting opposite vertical edges of the inner and outer surfaces, and a heater element positioned adjacent to an edge of an inner surface of the door. An articulating mullion is rotatably hinged at a second side of the door and supported in rotation between a first position when the door is in the closed position and a second position when the door is in the open position. In a closed position of the door, a front face of the mullion is adjacent to the heating element.

In another exemplary aspect, a refrigerator appliance is provided. The refrigerator appliance defines a vertical direction, a lateral direction, and a transverse direction. The refrigerator appliance includes a cabinet with first and second walls and a top and a bottom defining a chamber. The refrigerator appliance also includes a first door comprising a first inner surface and a first outer surface spaced apart from the first inner surface and a first side connecting a first edge of the first inner surface with a first edge of the first outer surface and a second side connecting a second edge of the first inner surface with a second edge of the first outer surface. An articulating mullion is rotatably hinged at the second side and supported in rotation between a first position when the first door is in the closed position and a second position when the first door is in the open position, the articulating mullion having a front face. The first door is rotatably mounted at the first side to the first wall of the cabinet for rotation between a closed position in which the door sealingly encloses a portion of the chamber and an open position in which the chamber is not enclosed. In this exemplary aspect, the refrigerator appliance also includes a second door comprising a second inner surface and a second outer surface spaced apart from the second inner surface. The door further comprises a third side connecting a first edge of the second inner surface with a first edge of the second outer surface and a fourth side connecting a second edge of the second inner surface with a second edge of the second outer surface. A heating element is positioned adjacent to the first edge of the second inner surface. The second door is rotatably mounted at the fourth side to the second wall of the cabinet for rotation between a closed position in which the second door sealingly encloses a portion of the chamber and an open position in which the chamber is not enclosed.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
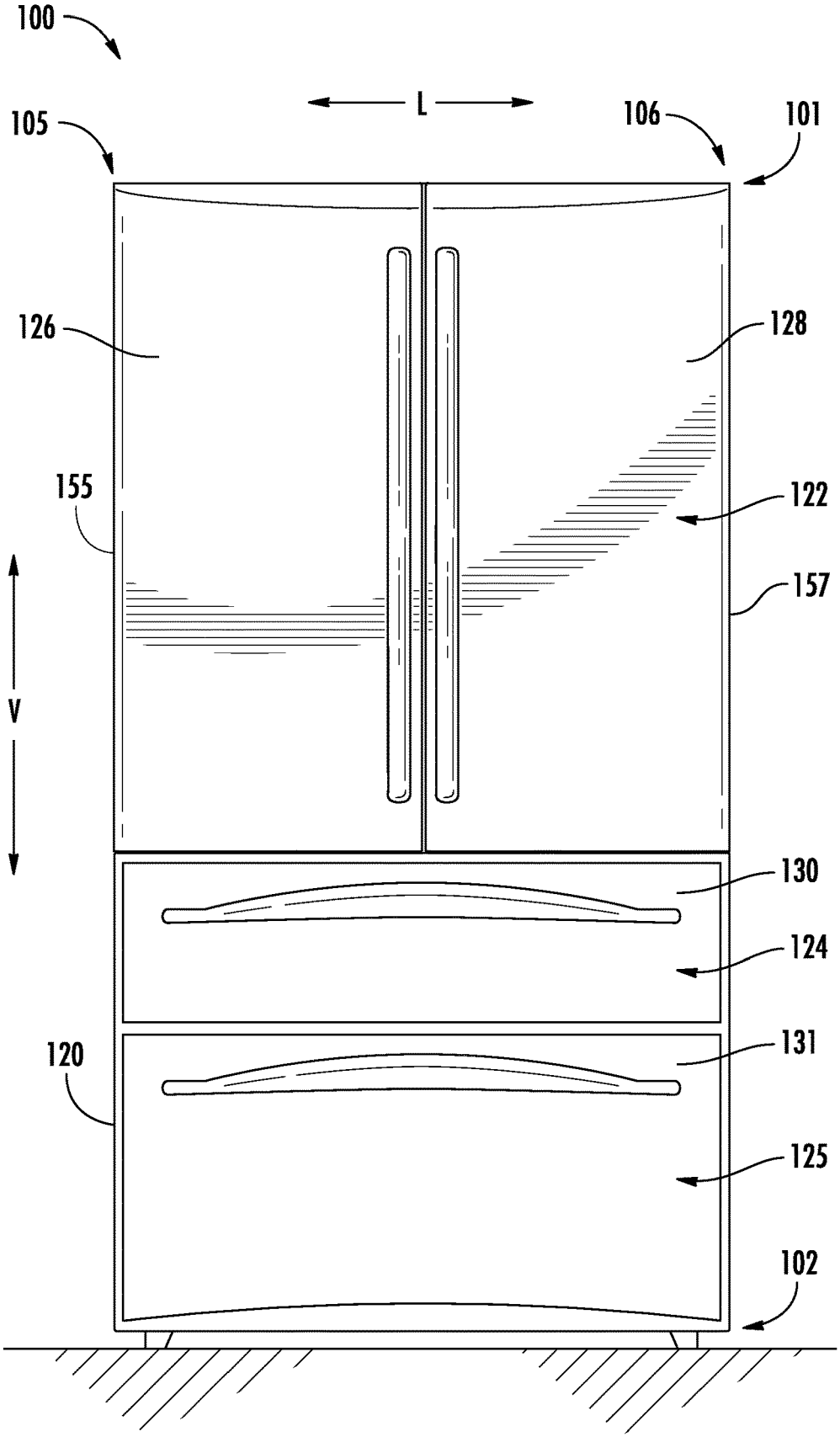
FIG. 1 provides a front view of a refrigerator appliance according to an exemplary embodiment of the present disclosure.

Reference now will be made in detail to embodiments of the invention, one or more examples of which are illustrated in the drawings. Each example is provided by way of explanation of the invention, not a limitation of the invention. It will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Condensation on articulating mullions for French door type refrigerator appliances has been a recognized problem. Typical solutions include a heater located within the mullion to heat at least the front face of the mullion to a temperature above the dew point for the ambient air. Power has been provided to the heater by routing current carrying wires from the door to the mullion, typically through the pivot attachment or hinge between the door and the mullion. However, as the hinge design becomes more complex, routing wires becomes more difficult as passages to carry the wires safely are no longer available. Openly routing wires from the door to the mullion create design and safety considerations. The present disclosure includes features that obviate the routing wires to the mullion in order to reduce or prevent condensation on the mullion without the noted drawbacks.

Using the teachings disclosed herein, one of skill in the art will understand that the present technology can be used with other types of refrigerators (e.g., side-by-side) or a freezer appliance as well. Consequently, the description set forth herein is for illustrative purposes only and is not intended to limit the technology in any aspect.

As used herein, the terms "first," "second," "third," and "fourth" may be used to distinguish one component from another and are not intended to signify importance of the individual components. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein. "Adjacent," as used herein, is intended to mean "lying near, close, or touching" in accordance with a generally accepted understanding of the word.

As used herein, "substantially" means within ten degrees (10°) of the noted direction or within about ten percent (10%) of the noted value or within manufacturing tolerances, whichever margin is greater, unless specifically stated otherwise. Unless otherwise specified, temperatures provided include a deviation of 5 Fahrenheit degrees (2.8 Celsius degrees). Moreover, as used herein, where a wall of articulating mullion (e.g., front wall) is described as being formed of a particular material, the wall can be considered formed of the particular material even if another material is attached thereto, integrated or embedded into the wall, or coated or plated onto a surface of the wall.

FIG. 1 provides a front view of an exemplary refrigerator appliance 100 according to an exemplary embodiment of the present disclosure. Refrigerator appliance 100 extends between a top 101 and a bottom 102 along a vertical direction V. Refrigerator appliance 100 also extends between a first side 105 and a second side 106 along a lateral direction L. Further, refrigerator appliance 100 extends between a front and a back along a transverse direction T (not shown), which is a direction orthogonal to the vertical direction V and the lateral direction L. Vertical direction V, lateral direction L, and transverse direction T are mutually perpendicular and form an orthogonal direction system.

Refrigerator appliance 100 includes a housing or cabinet 120 defining a fresh food chamber 122 and one or more freezer chambers, such as a first freezer chamber 124 and a second freezer chamber 125, which may both be arranged below fresh food chamber 122 along the vertical direction V. As illustrated, fresh food chamber 122 is bounded by vertical walls at the first side 105 and at the second side 106, such walls spaced apart in the lateral direction, a horizontal wall at the top 101 and at the bottom by a lower wall (stationary mullion 180). In this configuration, refrigerator appliance 100 may generally be referred to as a bottom mount, or bottom freezer, refrigerator. Cabinet 120 also defines a mechanical compartment (not shown) for receipt of a sealed cooling system (not shown). It will be appreciated that the present subject matter can be used with other types of refrigerator appliances as well, such as e.g., top mount, or top freezer, refrigerator appliances. Consequently, the description set forth herein is not intended to limit the present subject matter in any aspect.

First and second refrigerator doors 126, 128, respectively, are rotatably hinged to an edge of cabinet 120 at first 105 and second 106 sides, respectively, for accessing fresh food chamber 122, or sealing fresh food chamber 122 as illustrated in FIG. 1. For example, upper and lower hinges may couple each door 126, 128 to cabinet 120. When first and second doors 126, 128 are configured as illustrated in FIG. 1, the door arrangement is sometimes referred to as a "French door" configuration. Freezer doors, such as a first freezer door 130 and a second freezer door 131, may be arranged below refrigerator doors 126, 128 for accessing one or more freezer chambers, such as first and second freezer chambers 124, 125, respectively. In the exemplary embodiment shown in FIG. 1, freezer doors 130, 131 are coupled to freezer drawers (not shown) slidably coupled within first and second freezer chambers 124, 125. Such drawers are thus generally "pull-out" drawers in that they can be manually moved into and out of freezer chambers 124, 125 on suitable slide mechanisms. Each door 126, 128, 130, 131 can include a handle for accessing one of the chambers 122, 124, 125 of refrigerator appliance 100.

Figure 2:
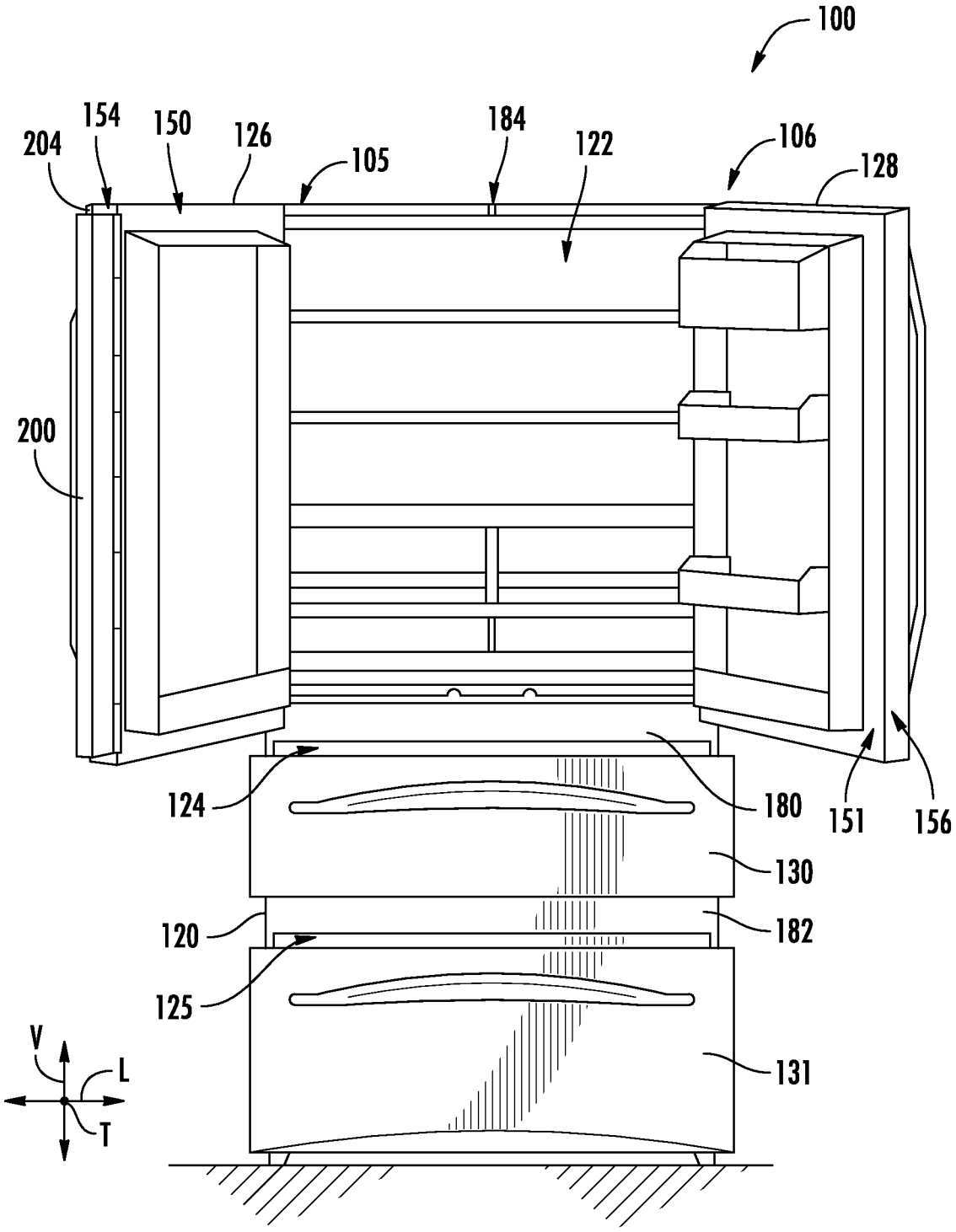
FIG. 2 provides a front view of the refrigerator appliance of FIG. 1 with refrigerator doors shown in an open configuration.

FIG. 2 provides a front perspective view of refrigerator appliance 100 showing refrigerator doors 126, 128 in an open position to reveal the interior of fresh food chamber 122. Additionally, freezer doors 130, 131 are shown in partially open positions to reveal a portion of the interior of freezer chambers 124, 125, respectively.

Figure 3:
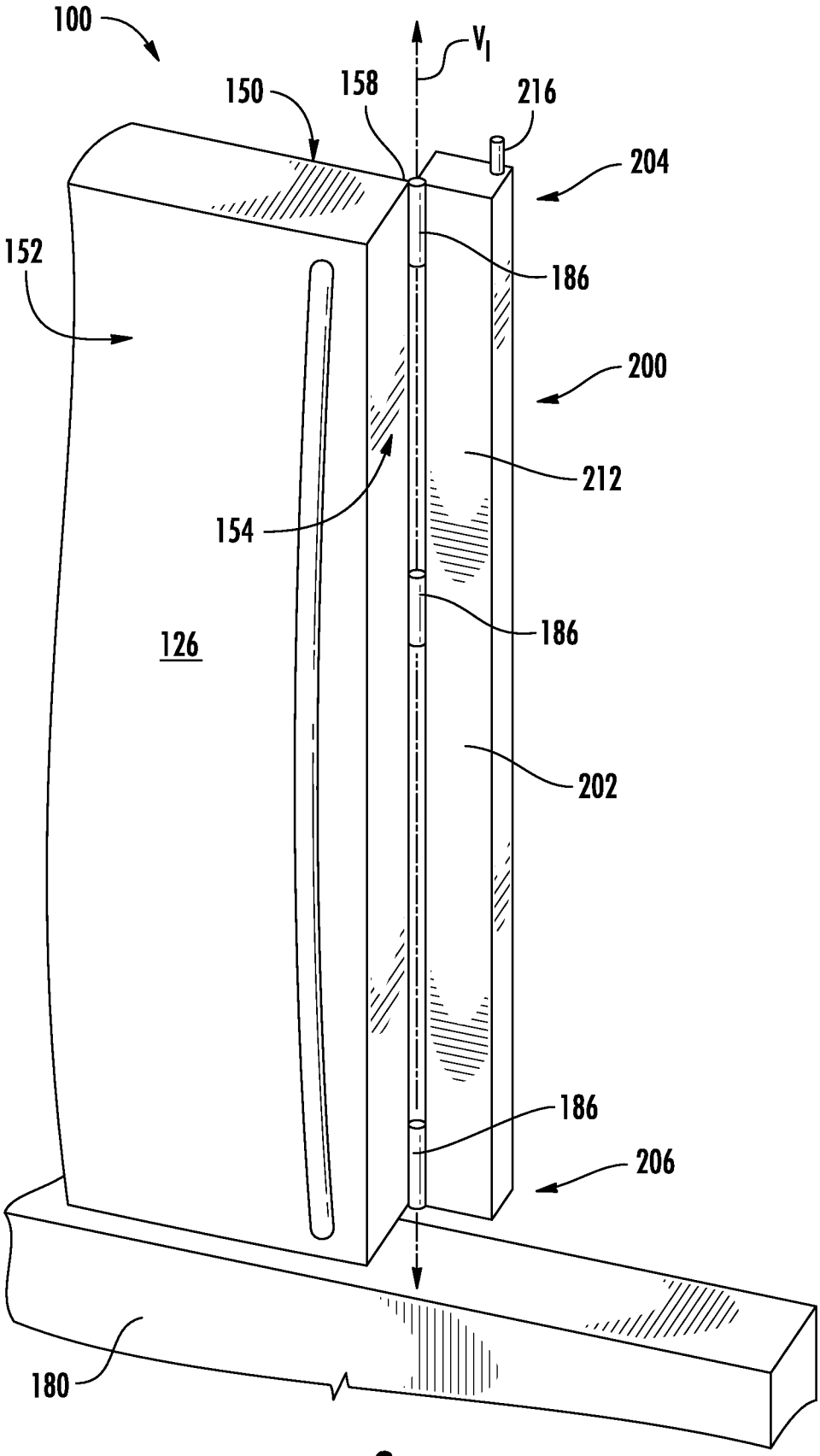
FIG. 3 provides a perspective view of a door and an articulating mullion connected to the door of the refrigerator appliance of FIG. 1.

Door 126 of refrigerator appliance 100 includes an inner surface 150 and an outer surface 152 (FIG. 3). Inner surface 150 generally defines a portion of the interior of fresh food chamber 122 when door 126 is in a closed position as shown in FIG. 1. Outer surface 152 is generally opposite inner surface 150 and defines a portion of the exterior of refrigerator appliance 100 when door 126 is in the closed position. Door 126 includes first and second side surfaces 154, 155, respectively, extending between and connecting inner surface 150 and outer surface 152. As illustrated for example in FIG. 3, the intersection of first inner surface 150 and first side surface 154 form edge 158. The same construction may result in similarly formed edges at the other intersections of side surfaces 155, 156, 157 and inner surface 151 and outer surfaces 152, 153. It will be appreciated that door 128 can be configured in the same or similar manner as door 126 with inner surface 151, outer surface 153 and third and fourth side surfaces 156, 157, respectively, extending between and connecting inner surface 151 and outer surface 153. Moreover, it will further be appreciated that freezer doors 130, 131 can likewise include inner, outer, and side surfaces 150, 152, 154.

As further shown in FIG. 2, refrigerator appliance 100 includes various mullions to generally divide the various chambers of refrigerator appliance 100 and/or prevent leakage therefrom. In the present embodiment of a French door refrigerator, refrigerator appliance 100 includes an articulating mullion 200 disposed on first door 126 and a stationary mullion 180 as a lower wall disposed between and separating fresh food chamber 122 and first freezer chamber 124. Refrigerator appliance 100 also includes a stationary mullion 182 disposed between and separating first freezer chamber 124 and second freezer chamber 125. Stationary mullions 180, 182 generally extend along the lateral direction L between first end 105 and second end 106 of refrigerator appliance 100 and generally extend along the vertical direction V to separate the various chambers of refrigerator appliance 100. Moreover, although not shown in FIG. 2, stationary mullions 180, 182 generally extend along the transverse direction T approximately the depth of refrigerator appliance 100. Articulating mullion 200 is positioned so that a long axis of the mullion 200 is parallel to the vertical direction V as illustrated in, for example, FIG. 2.

Refrigerator appliance 100 includes an articulating mullion 200 rotatably coupled or connected to door 126 as shown in FIG. 2. In other embodiments, articulating mullion 200 can be connected to door 128. In yet other embodiments, articulating mullion 200 can be connected to any suitable door of refrigerator appliance 100. Moreover, refrigerator appliance 100 can include any suitable number of articulating mullions 200. For example, where refrigerator appliance 100 has a quad door configuration (i.e., having two rotatably mounted "French door" fresh food doors and two rotatably mounted "French door" freezer doors positioned below the fresh food doors), refrigerator appliance 100 can include one articulating mullion 200 connected to one of the freezer doors and one articulating mullion connected to one of the fresh food doors.

Figure 4:
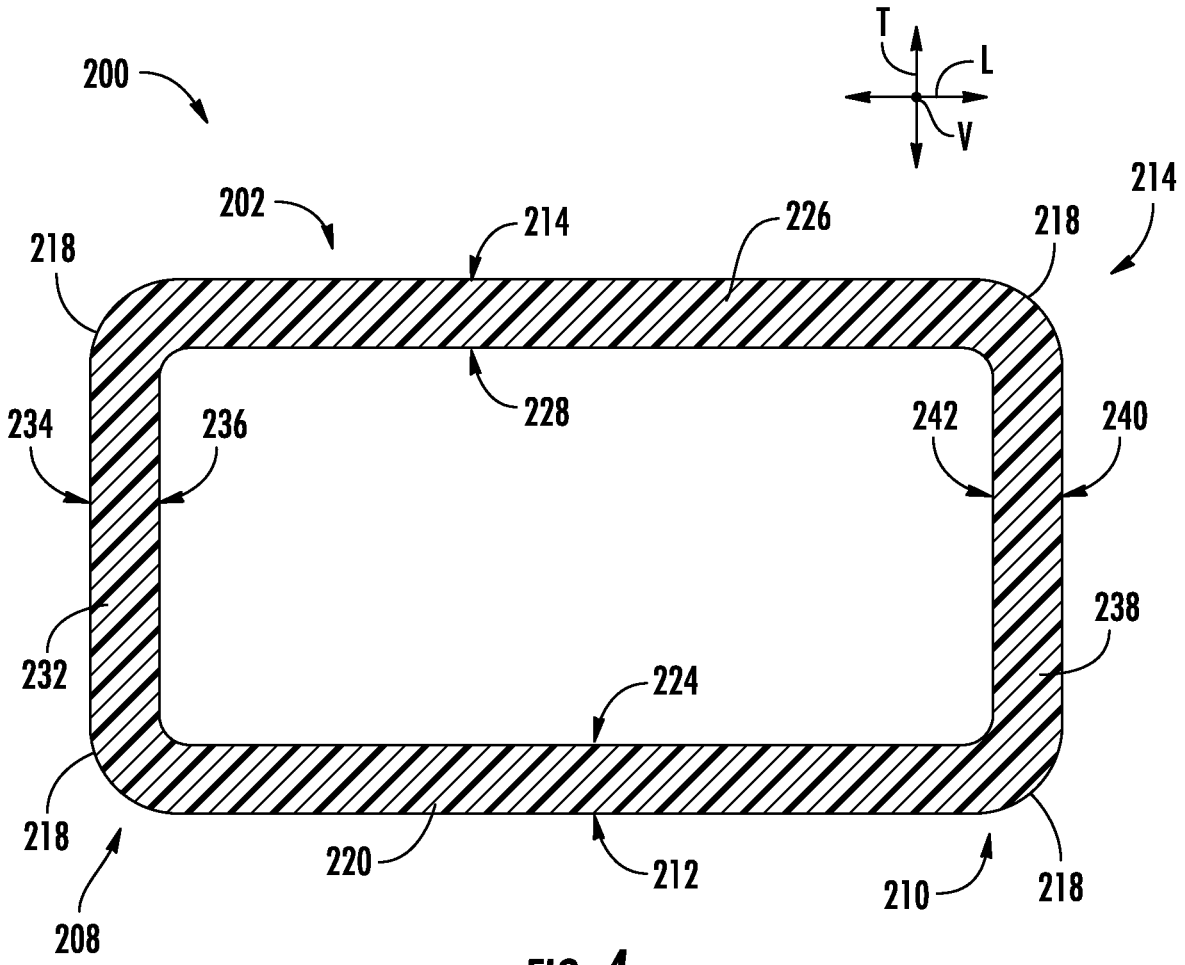
FIG. 4 is a cross-sectional view of the articulating mullion of FIG. 3.

Referring now to FIGS. 3 and 4, FIG. 3 provides a perspective view of an exemplary first door 126, stationary mullion 180, and articulating mullion 200 connected to door 126 of exemplary refrigerator appliance 100 of FIGS. 1 and 2. FIG. 4 provides a cross-sectional view of exemplary articulating mullion 200 of FIGS. 2 and 3.

As shown in FIG. 3, articulating mullion 200 can be rotatably coupled or rotatably hinged, via hinges 186, to door 126. Articulating mullion 200 can be rotated or articulated about a vertical axis $V_1$, which extends along the vertical direction V through hinges 186 as shown. Articulating mullion 200 can include additional hinges 186 or hinge components thereof in some exemplary embodiments.

Articulating mullion 200 includes a body 202. For this exemplary embodiment, body 202 has a generally rectangular cross-sectional shape. It will be appreciated that body 202 can have any suitable cross-sectional shape as will be apparent to an ordinarily skilled artisan. Body 202 extends between a top portion 204 and a bottom portion 206 along the vertical direction V (FIG. 3), between a first end 208 and a second end 210 along the lateral direction L (FIG. 4), and between a front face 212 and a rear face 214 along the transverse direction T (FIG. 4).

Articulating mullion 200 includes a tab 216 extending from body 202 as shown in FIG. 3. For this exemplary embodiment, tab 216 extends from top portion 204 of body 202. In some embodiments, tab 216 can extend from bottom portion 206 of body 202. In yet other embodiments, body 202 can include tabs 216 extending from both top portion 204 and bottom portion 206. Tab 216 may be sized and shaped to fit within and interact with a groove 184 defined in cabinet 120 of refrigerator appliance 100 (FIG. 2). For example, groove 184 may include cam surfaces that may interact with tab 216 to cause rotation of articulating mullion 200 from a first position to a second position when door 126 is rotated from a closed position (FIGS. 1 and 3) to an open position (FIG. 2) or vice versa.

As shown in FIG. 4, body 202 includes a front wall 220 having a front face 212 and a rear face 224 opposite front face 212. When door 126 is in the closed position, front wall 220 is oriented in a plane parallel to the vertical and lateral directions V, L. Likewise, front face 212 and rear face 224 of front wall 220 are coplanar with the vertical and lateral direction V, L. Body 202 also includes a rear wall 226 having a front face 228 and a rear face 214 opposite front face 228. Rear wall 226 extends in a plane parallel to the vertical and lateral directions V, L (when door 126 is in the closed position) and is spaced apart in the transverse direction T from front wall 220 as shown. Likewise, front face 228 and rear face 214 of rear wall 226 are parallel to the vertical and lateral direction V, L. Front face 212 of front wall 220 faces the exterior of refrigerator appliance 100 and rear face 214 of rear wall 226 faces the interior of refrigerator appliance 100 when door 126 is in a closed position.

Body 202 further includes a first sidewall 232 having a first face 234 and a second face 236 opposite first face 234. A transition portion 218 connects first sidewall 232 with front wall 220 at first end 208 of body 202. Another transition portion 218 connects first sidewall 232 with rear wall 226 at first end 208 of body 202. First sidewall 232 extends in a plane parallel to the transverse and vertical directions T, V when door 126 is in the closed position. Body 202 also includes a second sidewall 238 having a first face 240 and a second face 242 opposite first face 240. Another transition portion 218 connects second sidewall 238 with front wall 220 at second end 210 of body 202. Another transition portion 218 connects second sidewall 238 with rear wall 226 at second end 210 of body 202. Second sidewall 238 extends in a plane parallel to the transverse and vertical directions T, V (when door 126 is in the closed position) and is spaced apart from first sidewall 232 in the lateral direction L by front and rear walls 220, 226. For this embodiment, as shown in FIG. 4, body 202 formed by front wall 220, rear wall 226, and first and second sidewalls 232, 234 has a generally hollow shape. However, in some embodiments, articulating mullion 200 can be filled with an insulating material or can be formed as a solid member.

The body 202 of articulating mullion 200 may be formed from any suitable material or combination of materials. In some embodiments, at least front face 212 may include a thermally conductive material, for example a metal, as a component of at least front wall 220 with the remainder of the 202 formed from a non-metal, for example plastic, with lower thermal conductivity. In some cases, the thermally conductive material may be a coating applied to at least the front face 212 of body 202. According to exemplary embodiments, the interior of body 202 may be empty and may be filled with an insulating foam, for example polyurethane or expanded polystyrene, or other suitable filler.

Figure 5:
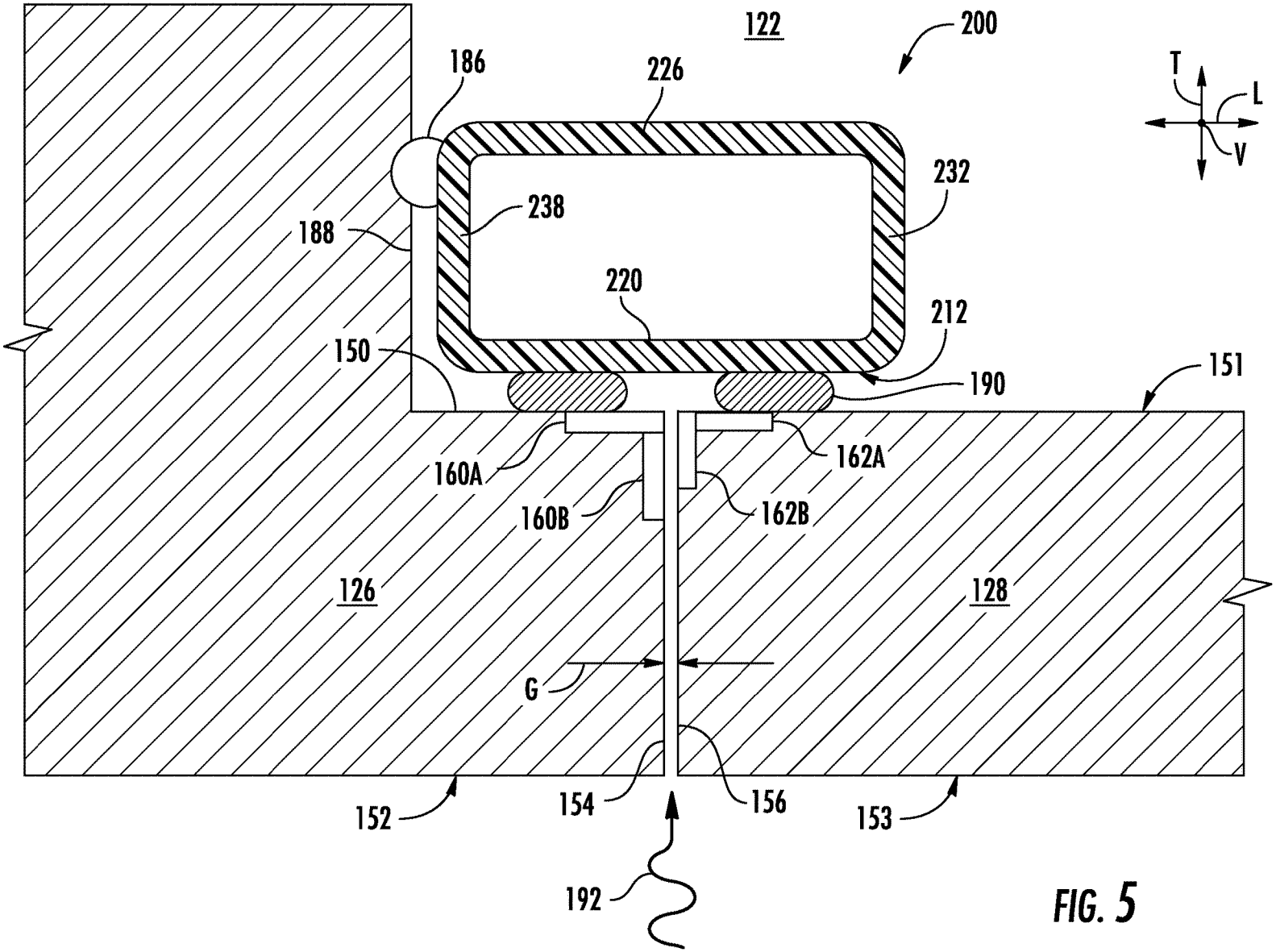
FIG. 5 is a cross-sectional view of doors of an exemplary refrigerator appliance in a closed position and contacting an exemplary articulating mullion according to an exemplary embodiment of the present disclosure.

FIG. 5 provides a close-up, cross-sectional view of first and second doors 126, 128 of exemplary refrigerator appliance 100 in a closed position and contacting articulating mullion 200 according to an exemplary embodiment of the present disclosure. For this embodiment, articulating mullion 200 is rotatably coupled or hinged to door 126 via hinge 186. In particular, articulating mullion 200 is rotatably coupled to a wall 188 of door 126. In other embodiments, articulating mullion 200 may be rotatably coupled to another portion of door 126.

As shown in FIG. 5, when doors 126, 128 are in a closed position, front face 212 of articulating mullion 200 generally overlaps the side surfaces 154 and 156 of doors 126, 128, respectively, along the lateral direction L. Accordingly, articulating mullion 200 may prevent leakage between doors 126, 128. More specifically, when doors 126, 128 are in a closed position, a gap G is defined between doors 126, 128. Ambient air 192, which is generally warm relative to the cooled or chilled air of fresh food chamber 122 (or similarly first or second freezer chambers 124, 125) of refrigerator appliance 100, flows through gap G and contacts front face 212 of front wall 220 of articulating mullion 200. As articulating mullion 200 is positioned to block the airflow through gap G, articulating mullion 200 prevents relatively warm ambient air 192 from leaking into refrigerator appliance 100. Articulating mullion 200 also prevents cooled or chilled air from flowing out of refrigerator appliance 100. To prevent such leakage, first and second inner surfaces 150, 151 of each door 126, 128, respectively, or gaskets 190 along such inner surfaces 150, 151, contact front face 212 of articulating mullion 200. To hermetically seal front face 212 with doors 126, 128, each door 126, 128, or one or more gaskets 190, and articulating mullion 200 can include magnets or comprise materials having magnetic properties to seal doors 126, 128 in sealing engagement with articulating mullion 200. For example, front face 212 may be formed from a magnetic material, or plated with a magnetic material, to facilitate sealing with magnetic material in the gasket 190. In some embodiments, the front wall 220 may be formed from a magnetic material to achieve the same result.

In embodiments of the present invention, door 126 includes a heating element 160A adjacent to edge 158 (FIG. 3). In the illustrative embodiment of FIG. 5, heating element 160A is positioned such it is in contact with first inner surface 150 and with side surface 154 of door 126. In such a configuration, heating element 160A is adjacent to edge 158. Similarly, exemplary embodiments may have heating element 160A spaced from either inner surface 150 or edge surface 154, or spaced apart from both inner surface 150 and edge 154, and still be adjacent to edge 158. Heating element 160A may extend in the vertical direction V adjacent to any portion of edge 158 or along the entire vertical length of edge 158. In some embodiments, heating element 160A may not be a continuous element adjacent to the edge 158 but may be made up of a plurality of segments spaced apart and extending along vertical direction V adjacent to the edge 158. In the exemplary embodiment of FIG. 5, heating element 160A is of rectangular cross section for ease of illustration only. Other cross-sectional configurations would offer similar benefits. The exemplary embodiment of FIG. 5 also illustrates heating element 160A aligned with (e.g., having a long axis parallel to) first inner surface 150. In other embodiments, the heating element may be adjacent to edge 158 and aligned with first side surface 154 (generally perpendicular to inner surface 150) as illustrated in FIG. 5 as heating element 160B. In other embodiments, heating elements 160A and 160B may be used together to heat the vertical V edge 158 or portions thereof. In other embodiments, one heating element, for example 160A, may be L-shaped with one leg aligned with first inner surface 150 and one leg aligned with first side surface 154. Other heating element configurations offer similar benefits.

In an exemplary embodiment, second fresh food door 128 has heating elements 162A and 162B arranged similarly to heating elements 160A and 160B, respectively. As with heating elements 160A and 160B in door 126, heating elements 162A and 162B may also extend along the vertical V length of door 128, or along portions of the door 128. In some embodiments, heating elements 160A and 160B are used in conjunction with heating elements 162A and 162B. In some embodiments, heating elements 162A and 162B are used instead of heating elements 160A and 160B. In other embodiments, any combination of heating elements 160A, 160B, 162A, and 162B may be used.

For ease of illustration heating elements 160A, 160B, 162A, and 162B are shown within the first and second doors 126, 128. In some embodiments, portions of the heating elements may extend through the inner surfaces 150, 151 or the side surfaces 154, 156. In other embodiments, the heating elements may be affixed to the outwardly facing surface of first and second inner surfaces 150, 151, the outwardly facing surface of side surfaces 154, 156, or any combination of the same.

Heating elements 160A, 160B, 162A, and 162B may be any suitable heating element capable of converting electric energy to heat, for example, through Joule heating. Such heating elements may, for example, be formed from a resistance wire, such as a wire of a nickel-chromium alloy, sometimes referred to as NiCr or nichrome wire. Any suitable composition of nickel and chromium, alone or with other metals or non-metals, may be used to form the resistance wire for use in heating elements 160A, 160B, 162A, and 162B. The wire may be encased in an electrical insulating material, such as a vinyl or silicone rubber sheath. One or more of the heating elements 160A, 160B, 162A, and 162B may be affixed to a portion of one of the doors 126, 128, for example with adhesive, an adhesive tape, or with mechanical fasteners or clips (not shown) to maintain positioning of the heating elements adjacent to the edge 158.

Suitable heating elements 160A, 160B, 162A, 162B can generate heat sufficient to increase the temperature of first inner surface 150, or side surface 154, at edge 158 above a predetermined temperature. In some cases, the predetermined temperature is the maximum anticipated dew-point temperature of the ambient air 192. When the door with the rotatably attached articulated mullion 200 (door 126 (FIG. 5) in the exemplary embodiment illustrated) is at least in the closed position as in FIG. 5, at least one of heating elements 160A, 160B, 162A, 162B is in thermal communication with front face 212 of articulating mullion 200 through at least edge 158. Thermal communication may be established between any one of the heating elements 160A, 160B, 162A, 162B and the front face 212 through first inner surface 150 or side surface 154, individually or in combination. The thermal communication relationship allows heat energy to flow through conduction, convection, or both conduction and convection from any one of the heating elements 160A, 160B, 162A, 162B to the front face 212 through at least one of the door surfaces 150, 154 or the edge 158. The thermal communication is sufficient to increase the temperature of front face 212 above a predetermined temperature, for example the maximum anticipated temperature of the ambient air 192. More particularly, the predetermined temperature for front face 212 may be within approximately 2 Fahrenheit degrees (1.1 degrees Celsius) of the maximum anticipated temperature of the ambient air 192.

In an exemplary embodiment, one or more of the heating elements 160A, 160B, 162A, and 162B, may increase the temperature of first inner surface 150 or side surface 154, or both first inner surface 150 and side surface 154, to a temperature sufficient to heat the ambient air 192 in gap G above a predetermined temperature. In some cases this predetermined temperature corresponds with the maximum anticipated dew-point temperature of the ambient air 192.

As will be appreciated, heat transfer occurs through conduction across the transverse thickness of articulating mullion 200 (i.e., the distance from front face 212 of front wall 220 to the rear face 214 (FIG. 4) of rear wall 226) due to the temperature differential between front wall 220 and rear wall 226. When the temperature of front face 212 is below the dew-point temperature of the surrounding ambient air 192, the water vapor within ambient air 192 may condense to a liquid phase on front face 212. Stated alternatively, front face 212 begins to "sweat." As the water vapor within the ambient air 192 condenses on the front face 212, drops of liquid water form on the front face 212 and, through the effects of gravity, tend to flow downwardly along the front face 212.

In such a circumstance according to an embodiment of the present invention, heating element 160A, or heating element 160B, or both 160A and 160B together, can heat a portion of door 126 adjacent to edge 158 to a predetermined temperature sufficient to heat the face 212 of articulating mullion 200 such that the condensed water is evaporated from front face 212. Moreover, front wall 220 is warmed to the predetermined temperature to prevent further condensation on front face 212 of front wall 220. In embodiments in which front wall 220 is formed from, or front face 212 is coated with, a thermally conductive material, such thermally conductive material may facilitate the heating of the front face 212.

In some embodiments, one or more of heating elements 162A and 162B, alone or in conjunction with one or more of heating elements 160A and 160B, operate to heat a portion of door 126 adjacent to edge 158 to a predetermined temperature as described above.

In other embodiments, any combination of heating elements 160A, 160B, 162A, and 162B may heat a portion of door 126, or door 128, or both doors 126, 128 to a predetermined temperature such that ambient air 192 in gap G is heated to a sufficient temperature such that the ambient air will not reach the dew-point temperature or below when in contact with front face 212 of articulating mullion 200.

Heating elements 160A, 160B, 162A, and 162B may have electrical power selectively applied to control the temperature of the door side surface 154 (or 156), the first inner surface 150 (or second inner surface 151), or in the gap G to prevent condensation forming on the front face 212 of articulating mullion 200. Electrical control circuits (not shown) may selectively provide power to one or more heating elements temporally, such that power may be cycled on and off to one or more heating elements on a timed basis. Similarly, electrical control circuits (not shown) may selectively provide power to one or more heating elements quantitatively, such that the rate of flow of electric charge (i.e., current) supplied to one or more heating elements can be varied. When more than one heating element is used, each may have power individually controlled as temperature requirements dictate.

In some embodiments, electrical control circuits (not shown) may include sensors, for example thermometer(s) or hygrometer(s), to determine temperature and humidity of the ambient air 192, and processor(s) to determine the selective power application to the heating elements 160A, 160B, 162A, and 162B. The electrical control circuits may selectively apply power to any one of the heating elements 160A,

160B, 162A, and 162B based on the open or closed position of the doors 126, 128. For example, power may be applied only when the door with the mullion attached (door 126 in the exemplary embodiment of FIG. 5) is in the closed position. In another example, power may be selectively applied only when both of the doors 126, 128 are in the closed position as illustrated in FIG. 5.

As will be appreciated, the portion of inner surface 150 of door 126 adjacent to edge 158 may include a thermally conductive material to facilitate heat transfer from the heating elements 160A to the front face 212 of the articulating mullion 200. Similarly, a portion of side surface 154 of door 126 adjacent to edge 158 may include a thermally conductive material to facilitate heat transfer from the heating elements 160B to the gap G. Door 128 may have a similar construction for at least the same beneficial effect.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the vertical, lateral, and transverse directions being mutually perpendicular, the refrigerator appliance comprising:

a cabinet comprising a first wall and a second wall, laterally spaced from the first wall, defining a lateral dimension of a chamber, a top and a bottom, vertically spaced from the top, defining a vertical dimension of the chamber;

a door comprising:

a first inner surface and a first outer surface spaced apart from the first inner surface;

a first side connecting a first edge of the first inner surface with a first edge of the first outer surface and a second side connecting a second edge of the first inner surface with a second edge of the first outer surface;

a first heating element positioned adjacent to the second edge of the first inner surface, wherein the first heating element is in direct contact with the first inner surface and the second side;

a second heating element directly affixed to the second side, wherein the second heating element is generally perpendicular to the first inner surface; and an articulating mullion rotatably hinged at the second side and supported in rotation between a first position when the door is in a closed position and a second position when the door is in an open position, the articulating mullion having a front face;

the door rotatably mounted at the first side to the first wall for rotation between the closed position in which the door sealingly encloses at least a portion of the chamber and the open position in which the chamber is not enclosed; and wherein the front face of the articulating mullion is adjacent to the first heating element and the second heating element when the articulating mullion is in the first position.

2. The refrigerator appliance of claim 1, wherein the first heating element is in thermal communication with the front face when the articulating mullion is in at least the first position.

3. The refrigerator appliance of claim 1, wherein the first heating element comprises a resistance wire.

4. The refrigerator appliance of claim 1, wherein the first heating element is electrically powered.

5. The refrigerator appliance of claim 4, wherein an electrical power supply is selectively applied to the first heating element.

6. The refrigerator appliance of claim 1, wherein the second heating element comprises a resistance wire.

7. The refrigerator appliance of claim 1, wherein the second heating element is electrically powered.

8. The refrigerator appliance of claim 7, wherein an electrical power supply is selectively applied to the second heating element.

* * * * *